US006017190A

United States Patent [19]

Lackey

[11] Patent Number: 6,017,190

[45] Date of Patent: Jan. 25, 2000

[54] CEILING FAN DOWNROD

[75] Inventor: Robert W. Lackey, Hickory, N.C.

[73] Assignee: Prime/Home Impressions, LLC, Hickory, N.C.

[21] Appl. No.: 09/003,642

[22] Filed: Jan. 7, 1998

[51] Int. Cl.[7] ..... F01D 25/00

[52] U.S. Cl. ..... 416/244 R; 416/5; 416/246; 417/423.15

[58] Field of Search ..... 416/5, 244 R, 416/246; 417/423.15

[56] References Cited

U.S. PATENT DOCUMENTS

| | | | |
|---|---|---|---|
| 4,073,598 | 2/1978 | Mizutani et al. | 416/5 |
| 4,621,977 | 11/1986 | Markwardt | 416/5 |
| 4,714,230 | 12/1987 | Huang | 248/613 |
| 4,729,725 | 3/1988 | Markwardt | 417/423 R |
| 4,878,806 | 11/1989 | Markwardt . | |
| 5,090,654 | 2/1992 | Ridings et al. . | |
| 5,135,365 | 8/1992 | Bogage | 417/423.15 |
| 5,183,233 | 2/1993 | LaPalomento | 248/343 |
| 5,302,083 | 4/1994 | Bucher et al. | 416/5 |
| 5,462,412 | 10/1995 | Scofield et al. . | |
| 5,507,619 | 4/1996 | Ryan | 416/5 |
| 5,851,107 | 12/1998 | Wang | 416/244 R |

*Primary Examiner*—Edward K. Look
*Assistant Examiner*—Matthew T. Shanley
*Attorney, Agent, or Firm*—Nexsen Pruet Jacobs & Pollard, LLP

[57] ABSTRACT

An apparatus for detachable connection of a ceiling fan motor housing to a ceiling mounting assembly. The ceiling fan downrod provides a standardized elongated tube that is connectable to a multitude of ceiling fan housings and assemblies, and provides a universal ground wire connection through a plurality of holes for electrical grounding of the apparatus. The downrod is an elongated tube with a hollow center, having a plurality of pairs of holes near each end of the downrod. Each open end of the downrod has a plurality of threads on the exterior surface of each end, the threads providing one connecting method to attach one end of the downrod to a ceiling mounting assembly, and the second end of the downrod to a motor housing of the ceiling fan. The downrod provides numerous options for connecting the downrod to ceiling fan assemblies, and provides versatility for attachment of electrical ground wires through the plurality of holes in the downrod.

22 Claims, 3 Drawing Sheets

CEILING FAN DOWNROD

BACKGROUND OF THE INVENTION

The invention relates generally to an apparatus for attaching a ceiling fan to a ceiling, and more particularly to a standardized downrod for attaching a ceiling fan motor housing to a ceiling bracket while providing a plurality of connecting mechanisms for attaching electrical ground wiring to the downrod.

Prior art devices exist concerning ceiling fan down rods. In Scofield, et al., U.S. Pat. No. 5,462,412, a ceiling fan is disclosed which includes a down rod secured between an upper stator and a lower motor portion, the down rod assisting with suspension of the motor from the ceiling. In Ridings, et al., U.S. Pat. No. 5,090,654, a ceiling fan adapter is disclosed that includes a down rod that interconnects with a ball-joint and a ceiling fan, allowing a ceiling hanger, the ceiling fan, the ball-joint, and the down rod to be mounted at an angle to a steep pitched ceiling. In Markwardt, U.S. Pat. No. 4,878,806, a dual mounting ceiling fan is disclosed that includes an adjustable down rod that allows for positioning of ceiling fan blades at variable distances from the ceiling. In Markwardt, U.S. Pat. No. 4,729,725, a ceiling fan mounting system is disclosed that includes a down rod that is adjustable and swivels, and fits into a canopy to which the motor housing fits of the ceiling fan.

Thus these and other downrods for mounting ceiling fans have shortcomings based on the lack of adjustability and the lack of a standardized design of the down rod devices for connection to ceiling fan mounting assemblies. There exists room for improvement within the art.

SUMMARY OF THE INVENTION

It is an object of this invention to provide an apparatus that suspends a ceiling fan from a ceiling mounting assembly.

It is a further object of this invention to provide an apparatus that allows for detachable connection to any combination of a mounting assembly and a motor housing of a ceiling fan.

It is an additional object of this invention to provide an apparatus that allows detachable connection of a plurality of electrical wires from a mounting assembly and a motor housing of a ceiling fan.

It is a further and more particular object of this inventions to provide an apparatus that is rigid and light in weight.

It is yet a further and more particular object of this invention to provide an apparatus that is inexpensive and attractive for use with a multitude of ceiling fan assemblies.

These and other objects of the invention are accomplished by a ceiling fan downrod apparatus which is attachable between a ceiling mounting assembly and a ceiling fan motor housing. The apparatus includes an elongated tube with a plurality of holes in the walls of the tube, the tube having an interior void, and an exterior surface having threading on each of a first open end and a second open end of the tube. Thus, the objects of the invention are accomplished by the ceiling fan downrod apparatus providing for physical and electrical connections of a ceiling mounting assembly with a ceiling fan motor housing as described herein.

BRIEF DESCRIPTION OF THE DRAWINGS

Various other features and advantages will become apparent from a reading of the following detailed description, given with reference to the various figures of drawing, in which.

DETAILED DESCRIPTION

Figure 1:
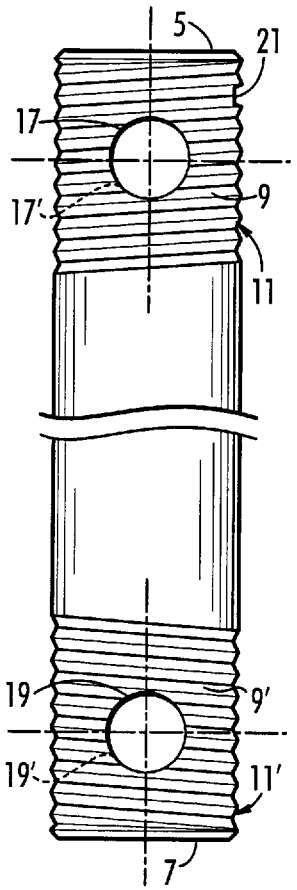
FIG. 1, is a side view of the ceiling fan downrod.
Figure 2:
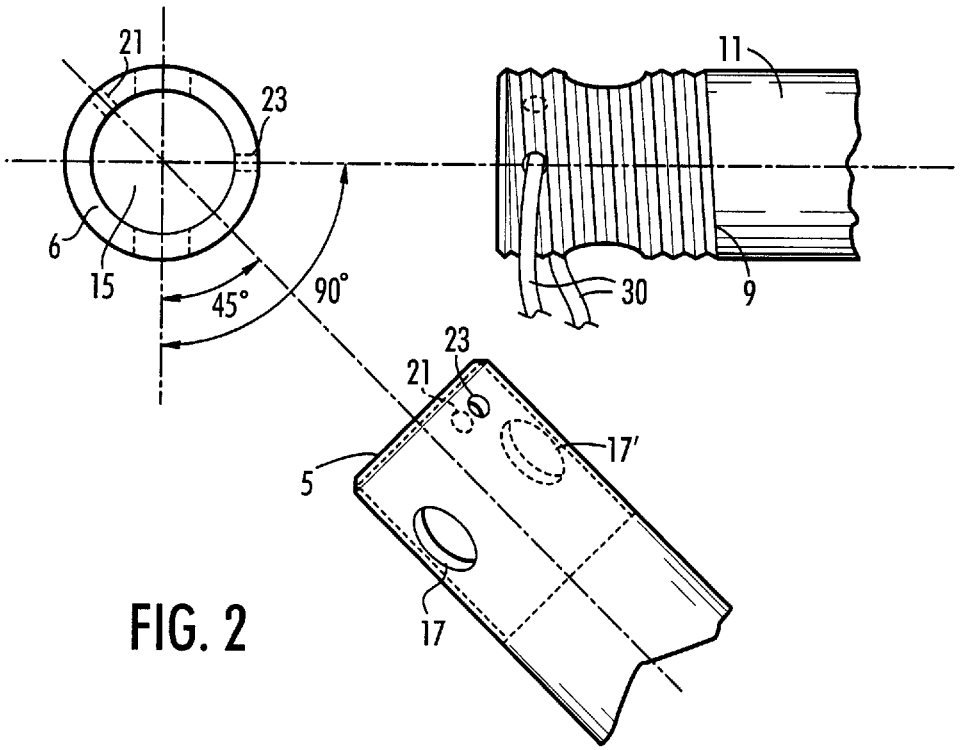
FIG. 2, is an end view of the ceiling fan downrod.

The preferred embodiment of the ceiling fan downrod 1 comprises an elongated tube 3 of metal. The downrod 1 provides a detachable connection between a ceiling fan F mounting assembly A and the motor housing H of a ceiling fan F assembly. The mounting assembly A includes a ball element B and connectors such as screw or bolts. The assembly A may include at least one ground wire (not shown) for attachment to the downrod 1 for electrical grounding of the downrod 1 and ceiling fan mechanisms attached to the downrod 1.

The downrod 1 includes an open first tube end 5 and an open second tube end 7 (FIGS. 1–4). The first 5 and second 7 ends have an exterior spiral threading 9 and 9' cut into the exterior surface 11 and 11' of each end 5 and 7. The length of the threads 9 and 9' on each end 5 and 7, extend from approximately 26 mm, or from approximately 21 mm, from the open ends 5 and 7 down the exterior of the tube 3 (see FIGS. 1 and 2).

The length 13 of the downrod 1 may vary in accordance with the size of the ceiling fan F to be installed, and the length of any additional support shaft S required for installation of the ceiling fan F. The inside diameter 15 of the interior void of the downrod 1 may vary.

The first open end 5 of the downrod 1 has a first pair of holes 17 and 17' placed opposite each other and drilled through the wall 6 of the tube 3. The center of each opposing hole 17 and 17' is placed approximately 11 mm from the open first end 5, with each hole having a diameter of approximately 8 mm.

The second open end 7 of the downrod 1 has a second pair of opposing holes 19 and 19' placed opposite each other and drilled through the wall 6 of the tube 3. The center of each opposing hole 19 and 19' is placed approximately 11 mm from the open second end 7, with each hole having a diameter of approximately 8 mm. The first pair 17, 17' and second pair 19, 19' of opposing holes located near each end 5, 7 of the tube 3, are intended to provide a plurality of holes to accommodate attaching screws or bolts (not shown). The plurality of holes allows the downrod 1 to detachably connect the first end 5 of the tube 3 to a ceiling mounting assembly (A), and to detachably connect the second end 7 to a ceiling fan motor housing (H).

A third pair of small groundwire holes 21 and 23 are drilled through the wall 6 in one end, preferably near the first open end 5 of the downrod 1. The third pair of holes 21 and 23 are drilled with the center of each hole approximately 5 mm from the first end 5 of the tube 3. Each hole is smaller in diameter, approximately 3 mm, than the first pair 17, 17', or the second pair 19, 19' of holes. The first hole 21 of the third pair of small groundwire holes is offset from the 8 mm diameter holes 17, 17' or 19, 19' at approximately a 45° angle as shown in FIGS. 1–4. The second hole 23 of the third pair of small holes is offset at approximately a 90° angle from the 8 mm diameter holes 17, 17' or 19, 19' as shown in FIGS. 1–4. The small holes 21 and 23 are intended to provide versatility for attachment of electrical ground wires 30 from various designs of a ceiling mounting assembly A, and ball element B, through the wall 6 of one end 5 or 7, of the tube 3. The downrod 1 of the present invention provides versatility for attachment of electrical ground wires, which is important for the present invention to provide a standardized downrod 1 that may be utilized for connecting a high percentage of the various designs of ceiling mounting assemblies and ball elements distributed by the ceiling fan industry.

Figure 5:
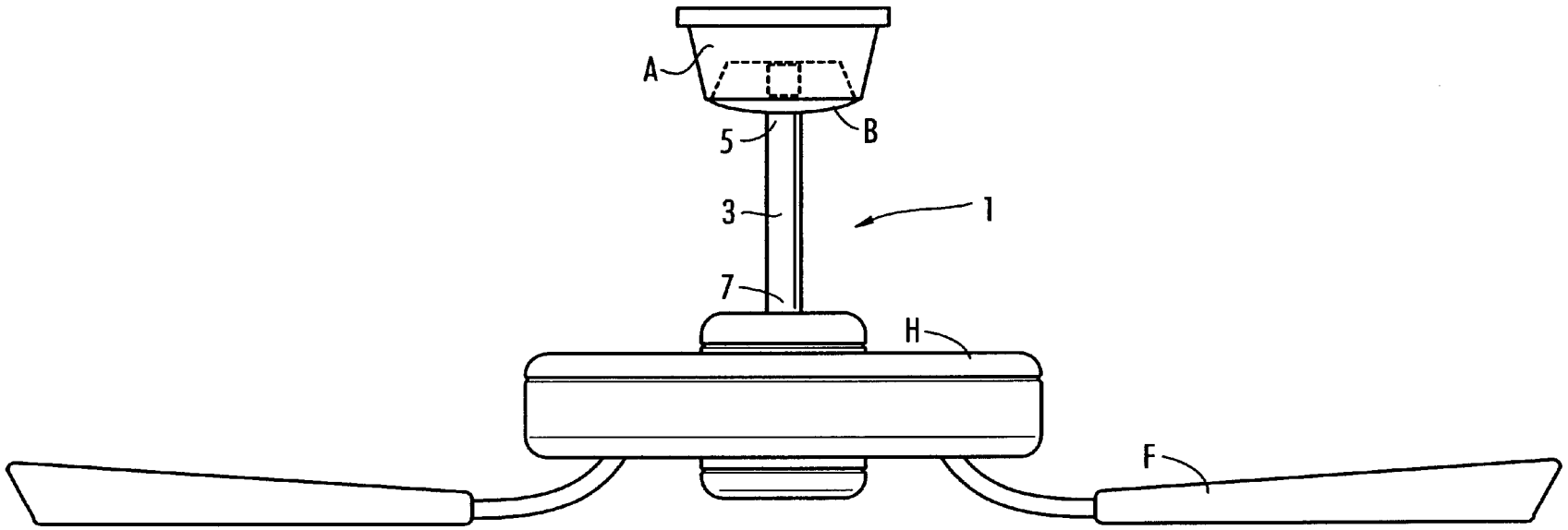
FIG. 5 is a perspective view of the ceiling fan downrod positioned between a ceiling fan motor housing and a ceiling mounting assembly.

An option for attaching the two ends 5 and 7 of tube 3 to a connecting mechanism of a ceiling mounting assembly (A), such as a hanger ball (not shown), and to a connecting mechanism of a ceiling fan motor housing (H), is to utilize the connecting means of the exterior spiral threading 9 and 9' cut into the exterior surface 11 and 11' of each end 5 and 7. The threads 9 and 9' inside each end 5 and 7 provide an alternative attaching means. The threading 9 and 9' allows the attachment mechanism of a ceiling mounting assembly hanger ball (B), to be screwed onto the first open end 5 of the tube 3, and the attachment mechanism of a ceiling fan motor housing (H), to be screwed onto the second open end 7 of the tube 3, forming a rigid connecting means for attaching a multitude of various designs of ceiling fan motor housings to various ceiling mounting assemblies (see FIG. 5). After connection of the downrod 1, then ground wires 30 may be connected to either of holes 21 or 23 near the end attached to a hanger ball (B). Thus, the downrod 1 of the subject invention provides a standardized connector for a plurality of ground wire attachments of the various ceiling fan designs.

Figure 3:
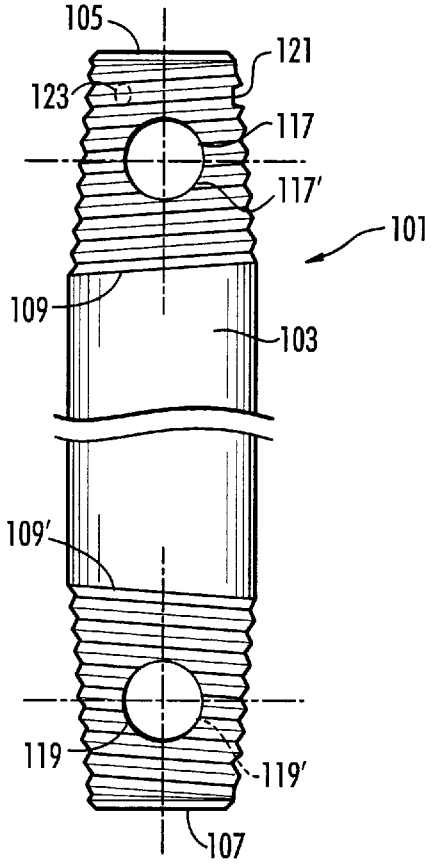
FIG. 3, is a side view of a ceiling fan downrod having tapered ends.
Figure 4:
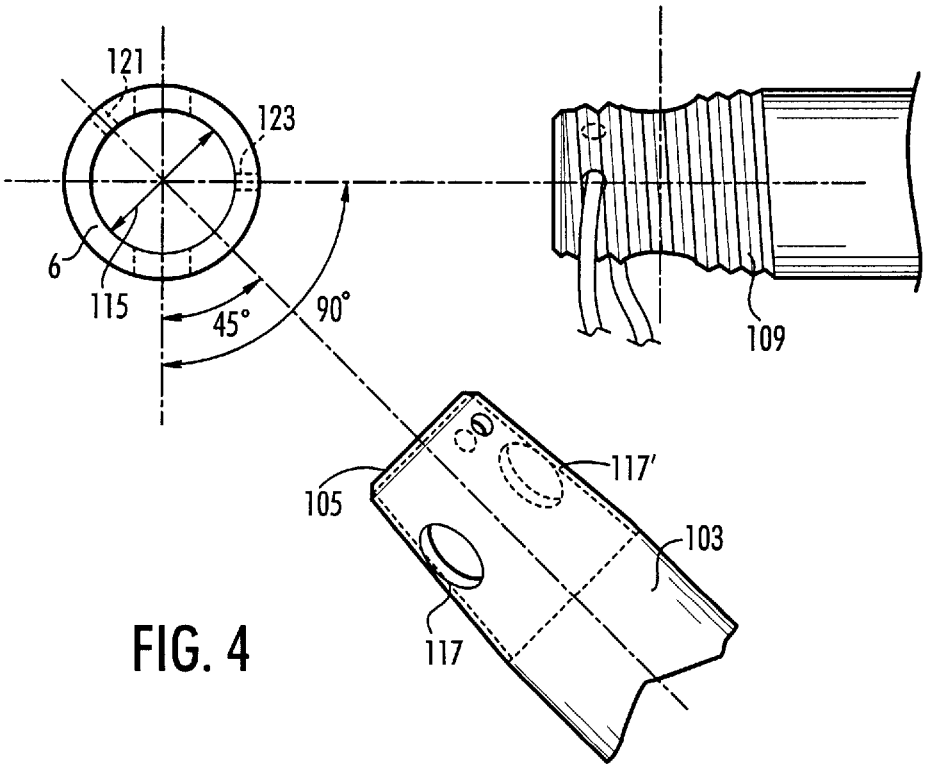
FIG. 4, is an end view of the ceiling fan downrod having tapered ends.

As a second embodiment, the downrod 101 includes an elongated tube 103, which has a first tube end 105 and a second tube end 107 that are hollow, circular, and tapered toward a smaller diameter at the ends 105 and 107 than the central diameter 108 of the tube 103. The tapering of the ends 105 and 107 begin approximately 21 mm inward from each end, with the tapering providing approximately a 1.5° tapered decrease in the diameter at the end of each tube end 105 and 107 of the tube 103. The other elements as described above for the first embodiment are incorporated in the second embodiment as shown in FIGS. 3 and 4. The other elements of the second embodiment include the external threads 109 and 109' on the external surface of each tube end 105 and 107, the first set of opposing holes 117 and 117', the second set of opposing holes 119 and 119', and the third set of smaller holes 121 and 123.

The ceiling fan downrod 1 and 101 may be manufactured of plastic, fiberglass, metal, or a ceramic composite material. Any color of the exterior surface is possible.

Although the present invention has been described in considerable detail with reference to certain preferred versions thereof, other versions are possible.

It is thus seen that the apparatus of this invention provides an interchangeable downrod 1 for attachment between the ceiling mounting assembly A, hanger ball B and the fan motor housing H of a ceiling fan F. The downrod 1 is a versatile elongated tube 3 that is detachably attached between the ceiling mounting assembly A and the fan motor housing H, to provide a variety of attachment means for connecting electrical ground wires from the hanger ball B through the downrod 1, for grounding of the down rod 1 and fan motor housing H of a variety of ceiling fans F.

Many variations will undoubtedly become apparent to one skilled in the art upon a reading of the above specification with reference to the drawings. As the foregoing description is exemplary in nature, the spirit and scope of the appended claims should not be limited to the description of the preferred versions contained herein.

What is claimed is:

1. A ceiling fan downrod apparatus adapted to attach a ceiling fan to a ceiling surface, said apparatus comprising:

a ceiling fan mounting assembly;

a tube, said tube attachable to said assembly, a tube wall having a plurality of holes, at least a pair of said holes being ground wire holes for attachment of electrical ground wires through said tube wall;

a first end of the tube;

a second end of the tube; and a plurality of threads on the first end and the second end of the tube;

wherein the plurality of threads allow the tube to be detachably connectable between the mounting assembly and the ceiling fan having a motor housing, and the tube wall having a plurality of holes provide for electrical wires of the mounting assembly and the ceiling fan to be detachably connected through the wall of the tube.

2. The apparatus according to claim 1, wherein said tube is made from rigid material.

3. The apparatus according to claim 1, wherein said tube wall having a plurality of holes further comprises the tube wall at the first end having a first pair of holes and the tube wall at the second end having a second pair of holes.

4. The apparatus according to claim 3, wherein said first pair of holes and said second pair of holes further comprise opposing holes in said tube wall at each end of the tube.

5. The apparatus according to claim 4, wherein said opposing holes are approximately about 8 mm diameter.

6. The apparatus according to claim 4, wherein said opposing holes are centered approximately about 11 mm inward from each end of the tube.

7. The apparatus according to claim 4, wherein said tube wall having a plurality of holes further comprises the tube wall at said first end of the tube having a third pair of holes centered approximately about 5 mm inward from said first end of the tube.

8. The apparatus according to claim 7, wherein said third pair of holes further comprises a first hole of the third pair, said first hole centered at a 45° angle offset from the first pair of holes.

9. The apparatus according to claim 7, wherein said third pair of holes further comprises a second hole of the third pair, said second hole centered at a 90° angle offset from the first pair of holes.

10. The apparatus according to claim 1, wherein said plurality of threads further comprise spiral threads originating on an exterior surface of the first end and the second end, said threads extending along the exterior surface of the tube for a distance of approximately about 26 mm from the end.

11. A ceiling fan downrod apparatus attachable between a ceiling fan and a ceiling mounting assembly, said apparatus comprising:

an elongated tube, the tube attachable to the mounting assembly;

a fan motor housing, the housing attachable to the tube;

a tube wall having a plurality of holes through the tube wall, at least a pair of said holes being ground wire holes for attachment of electrical ground wires through said tube wall;

a first end of the tube;

a second end of the tube; and a plurality of spiral threads on the first end and the second end;

wherein the first end and the second end are tapered to a diameter at the end of the tube that is less than a central diameter of the tube;

wherein the plurality of spiral threads originates at each end of the tube and extends away from the end of the tube;

wherein the tube wall having the plurality of holes allows for detachable connection of electrical wires of the mounting assembly and the fan motor housing through the tube walls.

12. The apparatus according to claim 11, wherein said tube is made from rigid material.

13. The apparatus according to claim 11, wherein said tube wall having a plurality of holes further comprises the tube wall at the first end having a first pair of holes and the tube wall at the second end having a second pair of holes.

14. The apparatus according to claim 13, wherein the first pair of holes and the second pair of holes further comprise holes directly opposed at each end of the tube.

15. The apparatus according to claim 14, wherein said first pair of holes are centered approximately about 11 mm inward from each end of the tube.

16. The apparatus according to claim 11, wherein said tube wall having a plurality of holes further comprises the tube wall at said first end of the tube having a third pair of holes centered approximately about 5 mm inward from said first end of the tube.

17. The apparatus according to claim 16, wherein said third pair of holes further comprises a first hole of the third pair, said first hole centered at a 45° angle offset from the first pair of holes.

18. The apparatus according to claim 16, wherein said third pair of holes further comprises a second hole of the third pair, said second hole centered at a 90° angle offset from the first pair of holes.

19. The apparatus according to claim 11, wherein said plurality of threads further comprise spiral threads originating at an exterior surface of the first end and the second end, and extending along the exterior surface of the tube for a distance of approximately about 21 mm down the tube.

20. A downrod apparatus for attaching between a ceiling fan and a fan hanger ball assembly, said apparatus comprising:

a hollow tube, the tube connectable to the hanger ball assembly;

a ceiling fan motor housing, the housing attachable to the tube;

a first tube end, the first tube end having a first pair of holes through the tube wall;

a second tube end, the second tube end having a second pair of holes through the tube wall;

a connecting means in the first tube end and in the second tube end; and a third pair of holes through the first tube end;

wherein the connecting means provides for detachable connection of a threaded hanger ball assembly on the first tube end, and detachable connection of a threaded ceiling fan motor housing;

wherein the third pair of holes provides for detachable connection of electrical wires of the hanger ball assembly through the tube wall of the first tube end of the hollow tube.

21. The apparatus of claim 20, wherein the third pair of holes further comprises a first hole of the third pair, said first hole centered at a 45° angle offset from the first pair or the second pair of holes.

22. The apparatus according to claim 20, wherein said third pair of holes further comprises a second hole of the third pair, said second hole centered at a 90° angle offset from the first or second pair of holes.

* * * * *